US005641224A

United States Patent [19]

Makita et al.

[11] Patent Number: 5,641,224

[45] Date of Patent: Jun. 24, 1997

[54] CAR LAMP AND SOCKET COVER FOR USE WITH CAR LAMP

[75] Inventors: Hiroyuki Makita; Masahiro Kusagaya; Yasuo Ozawa, all of Shizuoka, Japan

[73] Assignee: Koito Manufacturing Co., Ltd., Tokyo, Japan

[21] Appl. No.: 563,115

[22] Filed: Nov. 27, 1995

[30] Foreign Application Priority Data

Nov. 28, 1994 [JP] Japan ..... 6-316056
Oct. 11, 1995 [JP] Japan ..... 7-288190

[51] Int. Cl.[6] ..... F21V 29/00

[52] U.S. Cl. ..... 362/294; 362/226; 362/373

[58] Field of Search ..... 362/61, 226, 267, 362/294, 345, 373; 277/29

[56] References Cited

U.S. PATENT DOCUMENTS 4,931,912 6/1990 Kawakami et al. ..... 362/294 X
5,457,616 10/1995 Grigorescu et al. ..... 362/294
5,536,019 7/1996 Bryant et al. ..... 362/294 X

*Primary Examiner*—Stephen F. Husar
*Attorney, Agent, or Firm*—Morgan, Lewis and Bockius LLP

[57] ABSTRACT

A socket cover integrally formed of elastic material for covering a bulb mounting hole formed in a lamp body of a car lamp including a lens for covering a front opening of the lamp body and a light source bulb mounted on the lamp body comprises a body fitting portion of the socket cover enclosing the bulb mounting hole, to be fitted to the bulb mounting hole formed in the lamp body, to be connected to s bulb fitting portion, and to receive fitted the light source bulb; a back surface wall defining ventilating holes disposed in upper and lower portions of the back surface wall; ventilating pipes connected to the ventilating holes and including outward openings facing downward; and an air introduction member connected with the outward opening of the ventilating pipe provided in a lower portion of the back surface wall for introducing open sir into an interior of the lamp body.

19 Claims, 9 Drawing Sheets

CAR LAMP AND SOCKET COVER FOR USE WITH CAR LAMP

BACKGROUND OF THE INVENTION

1. Field of the Invention

The present invention relates to a car lamp, and more particularly, to a socket cover for car lamp.

2. Discussion of the Related Art

Conventionally, a car lamp, to prevent and to eliminate fog on a reflecting surface within a lamp body and a lens from when the car lamp is turned on, allows the inside of the lamp body access the open air. This facilitates flow of the air into the lamp body when the car lamp is turned on.

An example of the conventional car lamp of the above type is a structure in which, as shown in FIG. 16, ventilating pipes b, allowing the inside and outside of lamp body a to access each other, are provided on and projected from the rear surface of the lamp body a. Bent tubes c each having an L-shaped side surface are mounted on the respective ventilating pipes b. The bent tubes c are used to prevent water, such as rainwater or the like, from invading the lamp body a through the ventilating pipes b.

However, in the above-mentioned conventional car lamp, separate members such as the bent tubes c and the like are necessary. This increases the cost of the car lamp. Also, the depth of the portions where the bent tubes c are provided becomes great. Accordingly, the space for car lamp becomes large.

SUMMARY OF THE INVENTION

Accordingly, the present invention is directed to a socket cover for use with a car lamp that substantially obviates one or more of the problems due to limitations and disadvantages of the related art.

An object of the present invention is the provision of a socket cover for use with a car lamp which can reduce the number of parts to thereby be able to reduce the cost thereof as well as reduce the size of a space in which the car lamp is provided.

Another object of the present invention is the provision of a socket cover for use with a car lamp having ventilating holes and ventilating pipes formed in the socket cover. The socket cover was already necessary for prevention of invasion of water at the position where the bulb mounting hole is formed. The inside and outside of the lamp body vent to each other through these ventilating holes and pipes. This eliminates the need for parts to be used exclusively for ventilation, thereby reducing the cost of the socket cover. Also, because the need for special provision of projecting portions for ventilation on the back surface of the lamp body is eliminated, the space required for the present car lamp can be reduced, Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, the invention includes a socket cover integrally formed of elastic material for covering a bulb mounting hole formed in a lamp body of a car lamp including a lens for covering a front opening of the lamp body and a light source bulb mounted on the lamp body including a body fitting portion of the socket cover enclosing the bulb mounting hole, to be fitted to the bulb mounting hole formed in the lamp body, to be connected to a bulb portion, and to receive fitted the light source bulb; a back surface wall defining ventilating holes disposed in upper and lower portions of the back surface wall; ventilating pipes connected to the ventilating holes and including outboard openings facing downward; and an air introduction member connected with the outward opening of the ventilating pipe provided in a lower portion of the back surface wall for introducing open air into an interior of the lamp body.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIES

Figure 1:
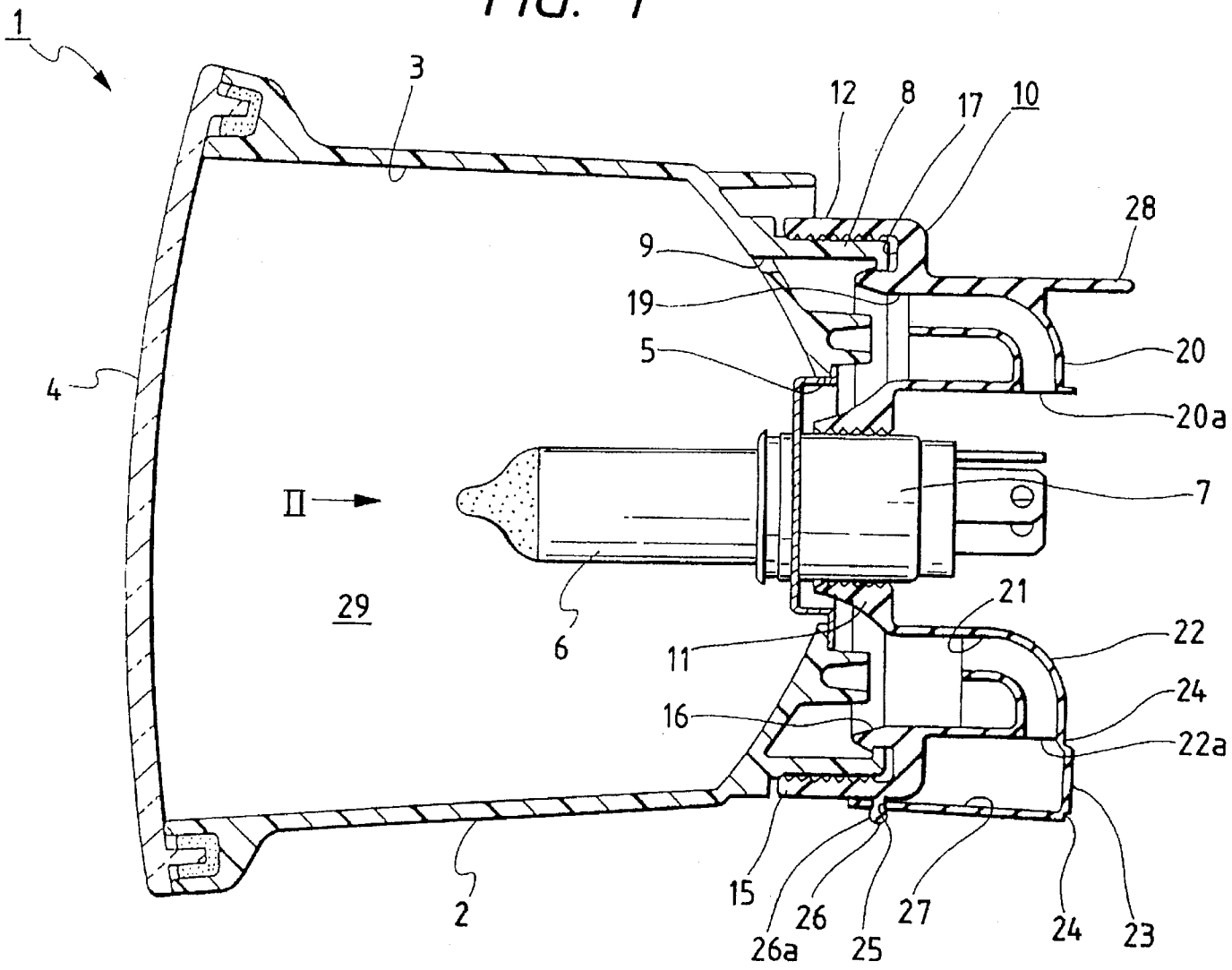
FIG. 1 is a longitudinal section view of a first embodiment of a car lamp employing a socket cover according to the invention.
Figure 2:
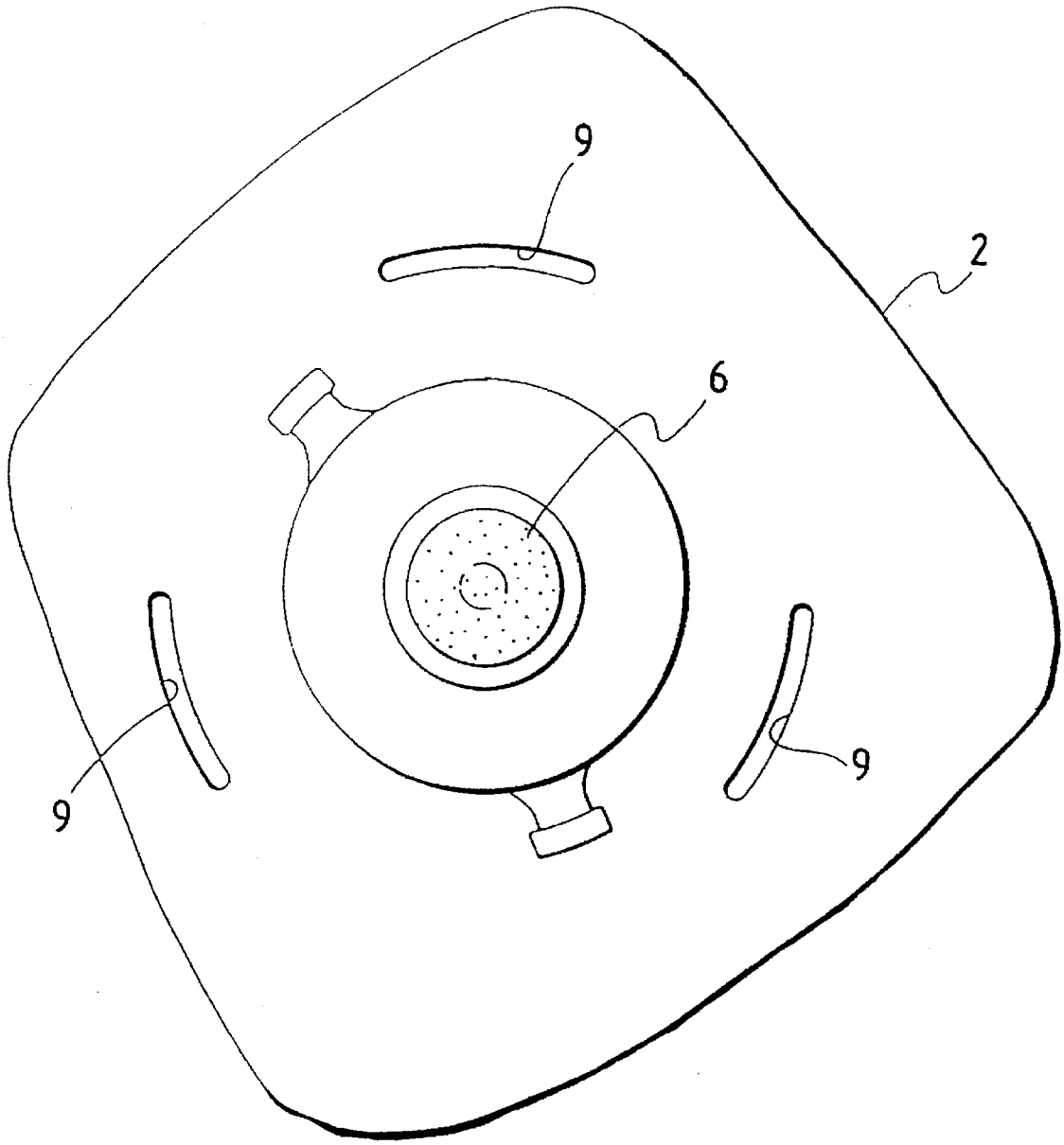
FIG. 2 is a view taken from the point of II shown in FIG. 1.
Figure 3:
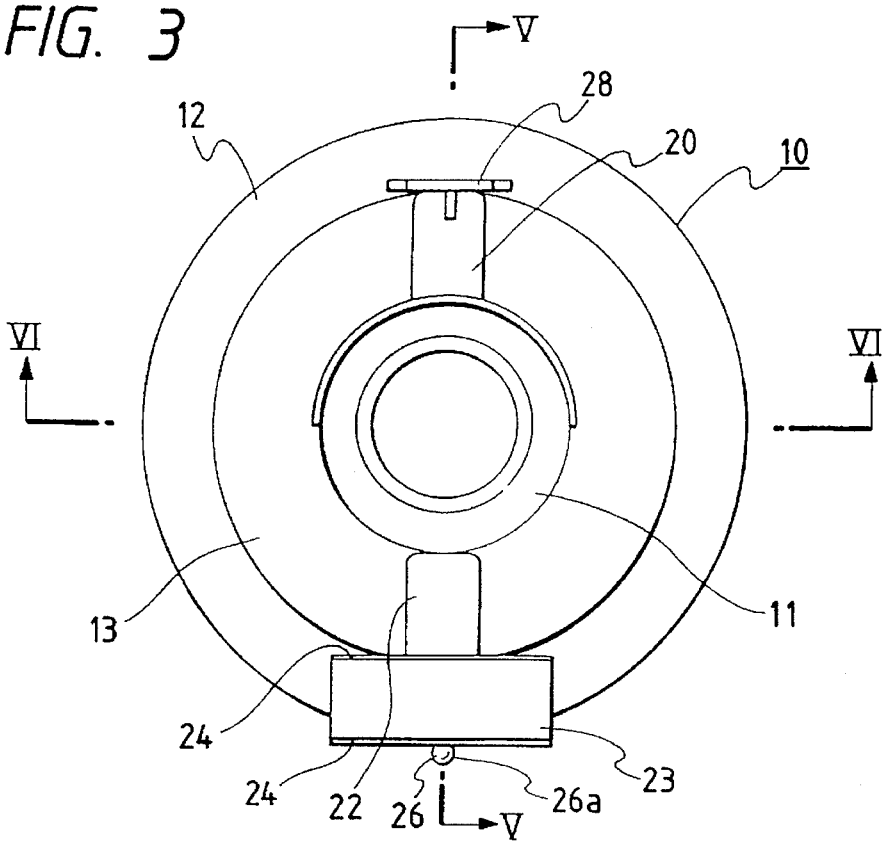
FIG. 3 is a back view of a socket cover shown in FIG. 1.
Figure 4:
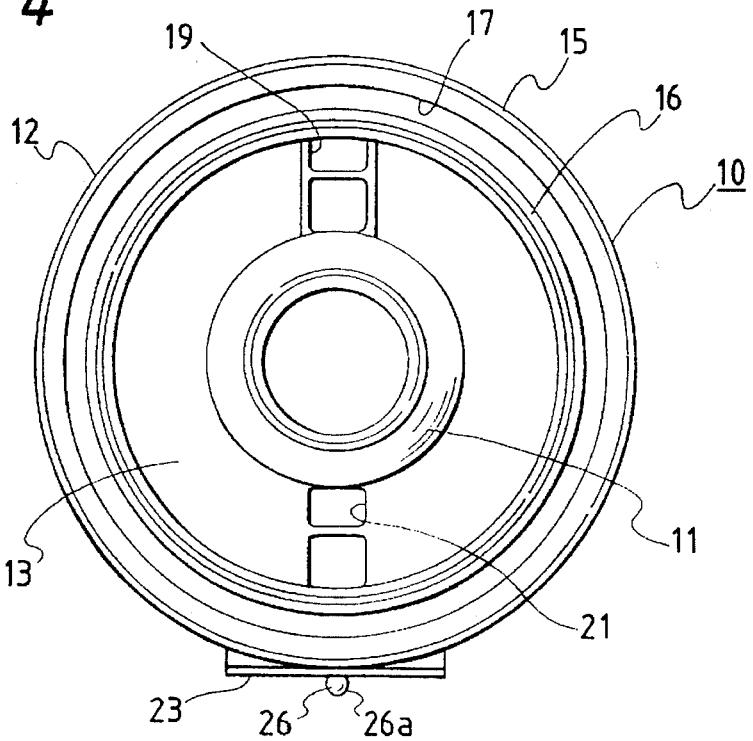
FIG. 4 is a front view of the socket cover shown in FIG. 1.
Figure 5:
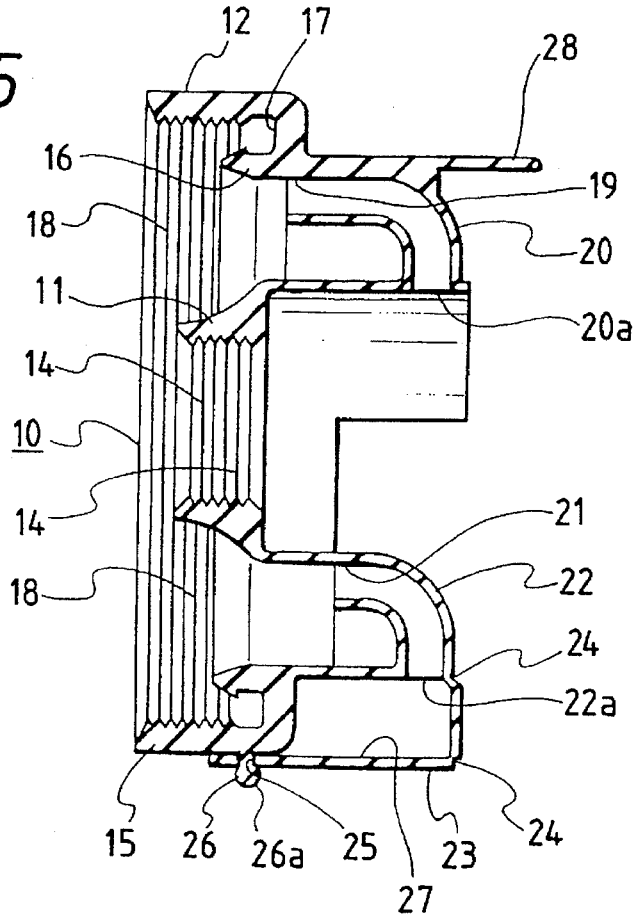
FIG. 5 is a section view taken along the line V—V shown in FIG. 3.
Figure 6:
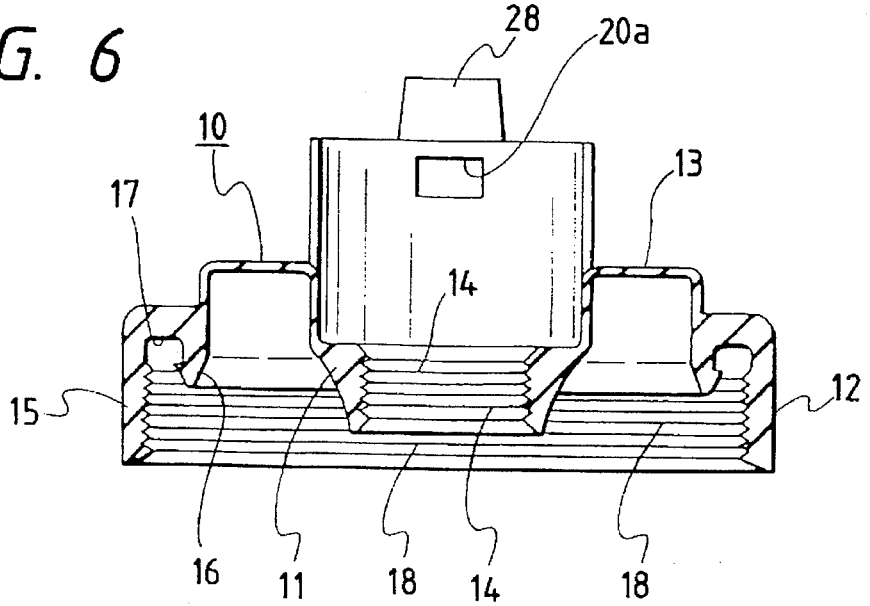
FIG. 6 is a section view taken along the line VI—VI shown in FIG. 3.
Figure 7:
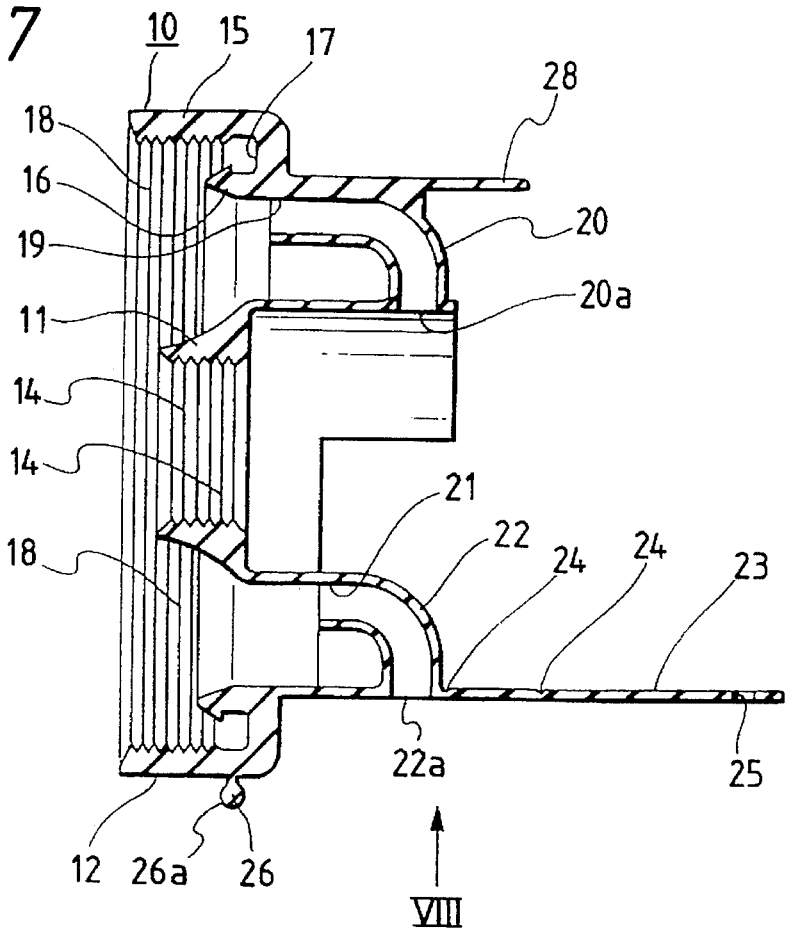
FIG. 7 is a section view taken along the same position as FIG. 5, showing the socket cover before an air introduction passage is formed.
Figure 8:
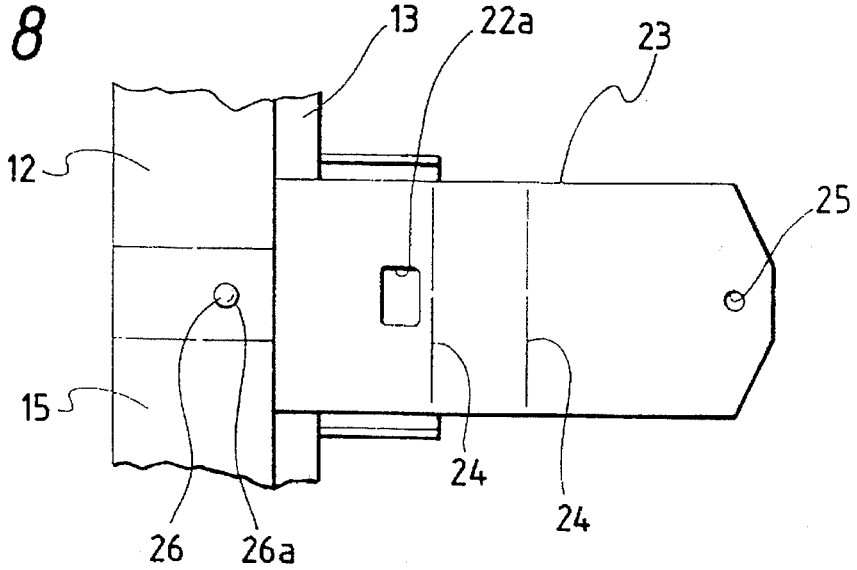
FIG. 8 is a view taken from the point VIII shown in FIG. 7.

Reference will now be made in detail to the present preferred embodiments of the invention, examples of which are illustrated in the accompanying drawings.

In particular, FIG. 1 to 8 show a first embodiment of a socket cover for use with a car lamp according to the invention. A car lamp 1 can be a car headlamp. A lamp body 2 of the car lamp includes a recessed portion 3 which is opened forward. The inner surface of the recessed portion 3 is treated so that it provides a reflecting surface.

A lens 4 is mounted on the lamp body 2 in such a manner that it covers the front opening of the lamp body 2. A bulb mounting hole 5 is formed substantially in the central portion of the rear portion of the lamp body 2, while a light source bulb 6 is removably mounted in the bulb mounting hole 5. A base portion 7 is part of the light source bulb 6.

At a position which encloses the bulb mounting hole 5 formed in the back surface of the lamp body 2, there is a short, cylindrical enclosing wall 8 such that it projects backwards. In the middle portion of the rear surface of the lamp body 2 that exits between the bulb mounting hole 5 and enclosing wall 8 forming portion, slits 9 are spaced radially from one another and are formed along the radial direction. One of the slits 9 is situated in the substantially upper part of such middle portion, whereas the remaining two slits 9 are respectively situated in the lower left part and the lower right part of such middle portion.

A socket cover 10 is formed of elastic material such as synthetic rubber or the like. The socket cover 10 includes a short, cylindrical bulb fitting portion 11 and a short, cylindrical body fitting portion 12 having a larger diameter than the bulb fitting portion 11 which are connected to each other by means of a back surface wall 13 into a united body.

As described above, the bulb fitting portion 11 of the socket cover 10 is of a short and cylindrical shape. Along whole length of the inner peripheral surface of the bulb fitting portion 11, there are a large number of annular projecting strips 14.

The body fitting portion 12 is to be fitted with the outside of an enclosing wall 8 provided at and projected from the position of the back surface of the lamp body 2 that encloses a bulb mounting hole 5. The body fitting portion 12 is connected to a bulb fitting portion 11 to be fitted with the outside of a base portion 7 of a light source bulb 6 by means of a back surface wall 13. As mentioned above, the body fitting portion 12 of the socket cover 10 also has a short and cylindrical shape, The body fitting portion 12 includes a cylindrical outer peripheral wall 15 and a cylindrical inner wall 16 which are connected to each other at the rear ends thereof. The length of the inner wall 16 is a little less than the length of the outer peripheral wall 15. Between the outer peripheral wall 15 and inner wall 16, there is a fitting groove 17 which opens forward. In the inner peripheral surface of the outer peripheral wall 15 except for the rear end portion thereof, there are provided a large number of annular projecting strips 18.

The back surface wall 13 of the socket cover 10 has a cross section of a U shape opened forward. The outer end of the back surface wall 13 is connected to the inner edge of the rear end of the body fitting portion 12. The inner end thereof is connected to the outer edge of the rear end of the bulb fitting portion 11. A ventilating hole 19 is formed in the upper half section of the back surface wall 13 that is situated right above the bulb fitting portion 11. The ventilating hole 19 is used as an air exhaust hole. A ventilating pipe 20 includes a substantially L-shaped section when it is viewed in the axial direction thereof and also includes an outer opening 20*a* facing downward. The inner end of the ventilating pipe 20 vents to the air exhaust hole 19.

A ventilating hole 21 is formed in the upper half section of the back surface wall 13 that is situated right below the bulb fitting portion 11. The ventilating hole 21 is used as an air suction hole. A ventilating pipe 22 includes a substantially L-shaped section when it is viewed in the axial direction thereof and also includes an outer opening 22*a* facing downward. The inner end of the ventilating pipe 22 is connected to the above-mentioned air suction hole 21.

An air introduction member 23 is a plate long in the longitudinal direction. The air introduction member is provided integrally with the body fluting portion 12 of the socket cover 10. The air introduction number 23 projects back from the outward opening 22*a* of the ventilating pipe 22. The width of the air introduction member 23 is approximately three times that of the ventilating pipe 22. The air introduction member 23 includes two thin portions 24 which are respectively formed on a first portion thereof in contact with the back surface of the ventilating pipe 22 and on a second portion thereof spaced back from the first portion in such a manner that they are across the air introduction member 23 in the width direction thereof. The distance between the two thin portions 24 is set approximately equal to the width of the body fitting portion 12. The air introduction member 23 includes an engaging hole 25 formed in the center of the rear end portion thereof.

A securing projection 26 is at the outer surface of the outer peripheral wall 15 immediately under the body fitting portion 12 at the rear end. The securing projection 26 includes a head portion 26*a* formed in the lower end thereof and having a slightly larger diameter then the other portions of the securing projection 26.

The air introduction member 23 is sequentially bent at substantially right angles at the thin portions 24 thereof. The rear end portion of air introduction member 23 is superimposed on the lower end face of the outer peripheral wall 15 of the body fitting portion 12. The securing projection is fitted into the engaging hole 25 of the air introduction member 23, so that the air introduction member 23 can be fixed. Thus, a substantially prismatic air introduction passage 27 is connected to outer opening 22*a* of the ventilating pipe 22, extends left and right, and opens left and right. An eaves wall 28 is just on and projects back from the ventilating pipe 20, forming portion of the back surface wall 13.

The socket cover 10 is mounted on the lamp body 2. The body fitting portion 12 of the socket cover 10 is fitted on the outside of the enclosing wall 8. The bulb fitting portion 11 thereof is fitted on the outside of the base portion 7 of the light source bulb 6. In this mounting operation, the rear end portion of the enclosing wall 8 is fitted onto the fitting groove 17 of the body fitting portion 12.

The projecting strips of the bulb fitting portion 11 are elastically connected with the base portion 7 of the light source bulb 6 and the leading ends thereof are thereby collapsed. The projecting strips of the body fitting portion 12 are elastically connected with the outer peripheral surface of the enclosing wall 8 and the leading ends thereof are thereby collapsed. Thus, water is prevented from passing through these elastically contacted portions.

A lamp space 29, which is defined by the lamp body 2 and lens 4, is connected to the outside through the slits 9 formed in the lamp body 2, ventilating holes 19, 21 ventilating pipes 20, 22, and air introduction passage 27. Therefore, if the light source bulb 6 is turned on and the air within the lamp space 29 is thereby warmed up, then air convection is produced within the lamp space 29. The open air is allowed to flow from the outside into the lamp space 29 through the air introduction passage 27, ventilating pipe 22, and air suction hole 21, while the air within the lamp space 29 is discharged out to the outside through the air exhaust hole 19 and ventilating pipe 20. In this manner, the air is allowed to flow within the lamp space 29, thereby being able to prevent the reflecting surface and lens from being fogged up and able to eliminate the fogged states of the reflecting surface and lens quickly when the light source bulb 6 is turned on, As described above, if the outer opening 22*a* of the ventilating pipe 22 connected the air suction hole 21 is allowed to circulate air with the air introduction passage 27 opened left and right, then the air can be sucked in sufficiently. Because the air coming to the back surface of the lamp body 2 flows as if creeping along the outer peripheral wall 15 and back surface wall 13 of the socket cover 10 and also because the left and right ends of the air introduction passage 27 are opened to the air flowing path, the open air is allowed to flow in from the left and right openings of the air introduction passage 27. Thus, with the result that the open air is pushed into the lamp space 29 from the air suction hole 21, thereby promoting the flow of the air within the lamp space 29.

The air introduction member 23 having the air introduction passage 27 prevents water from flowing from behind and from below directly into the outer opening 22*a* of the ventilating pipe 22, which is connected to the air suction hole 21. Thus, the air introduction member 23 prevents water from invading the ventilating pipe 22.

Figure 9:
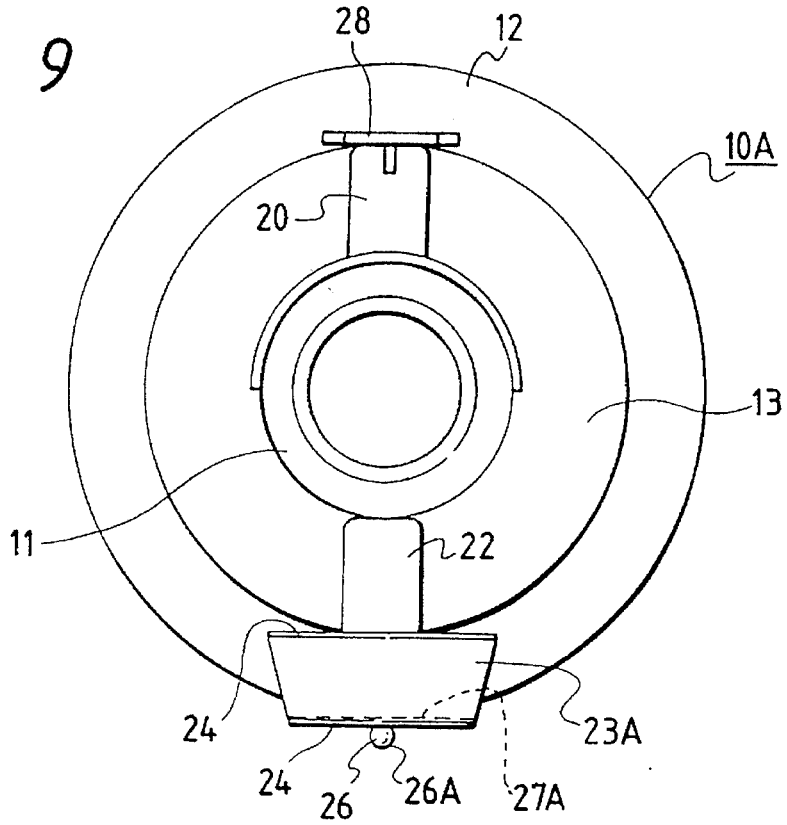
FIG. 9 is a back view of a modification of the socket cover.
Figure 10:
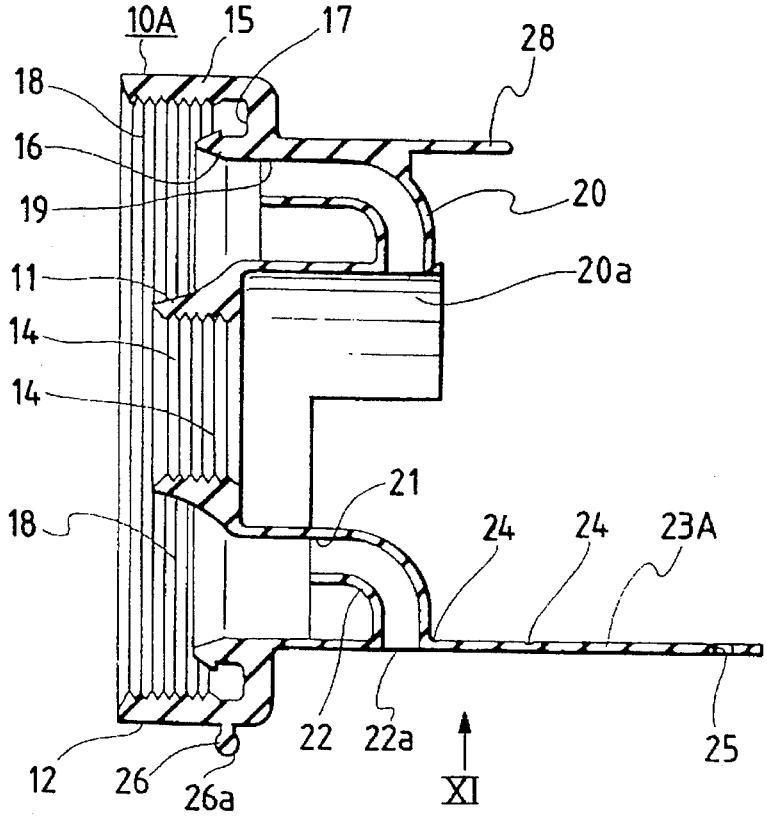
FIG. 10 is a longitudinal section view of the modification, showing an air introduction passage is formed.
Figure 11:
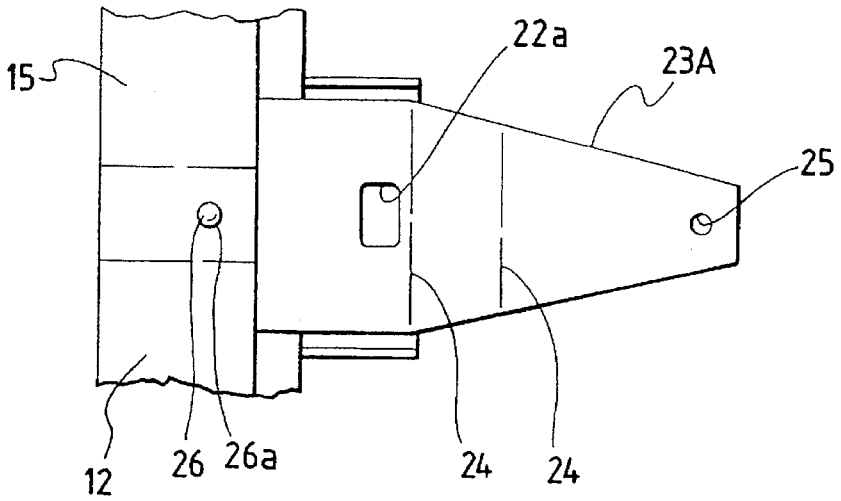
FIG. 11 is a view taken from the point XI shown in FIG. 10.
Figure 12:
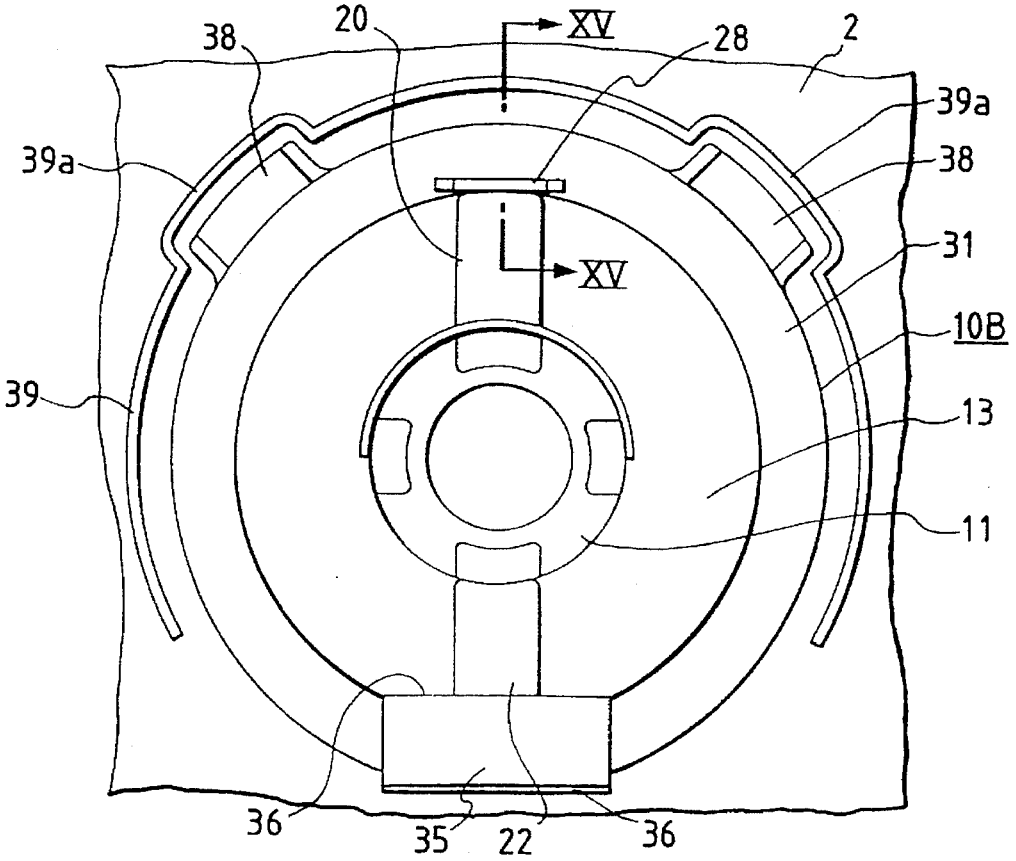
FIG. 12 is a back view of a second embodiment of the socket cover showing a state showing it mounted in the car lamp.
Figure 14:
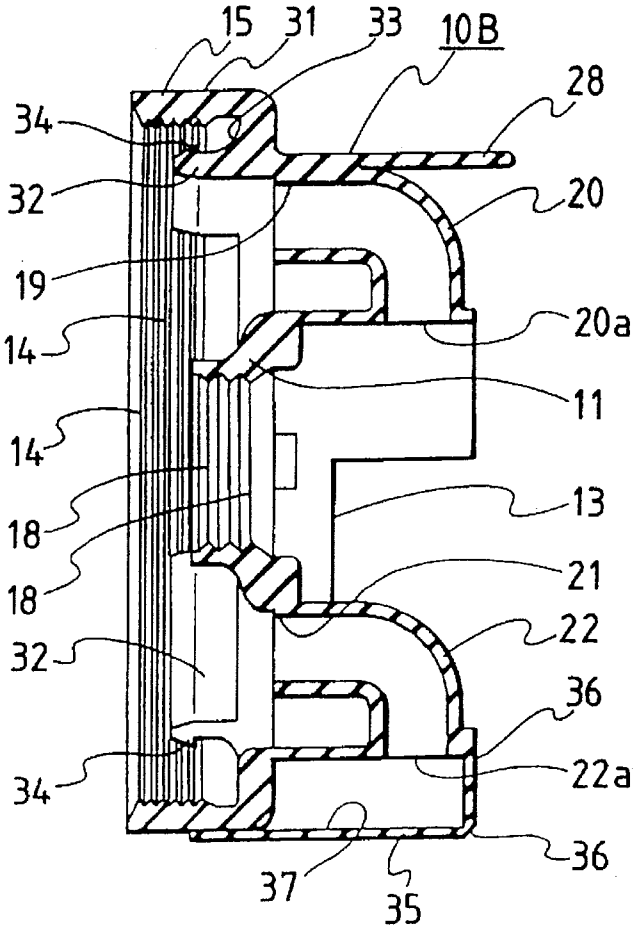
FIG. 14 is a section view taken along the line XIV—XIV shown in FIG. 13.
Figure 13:
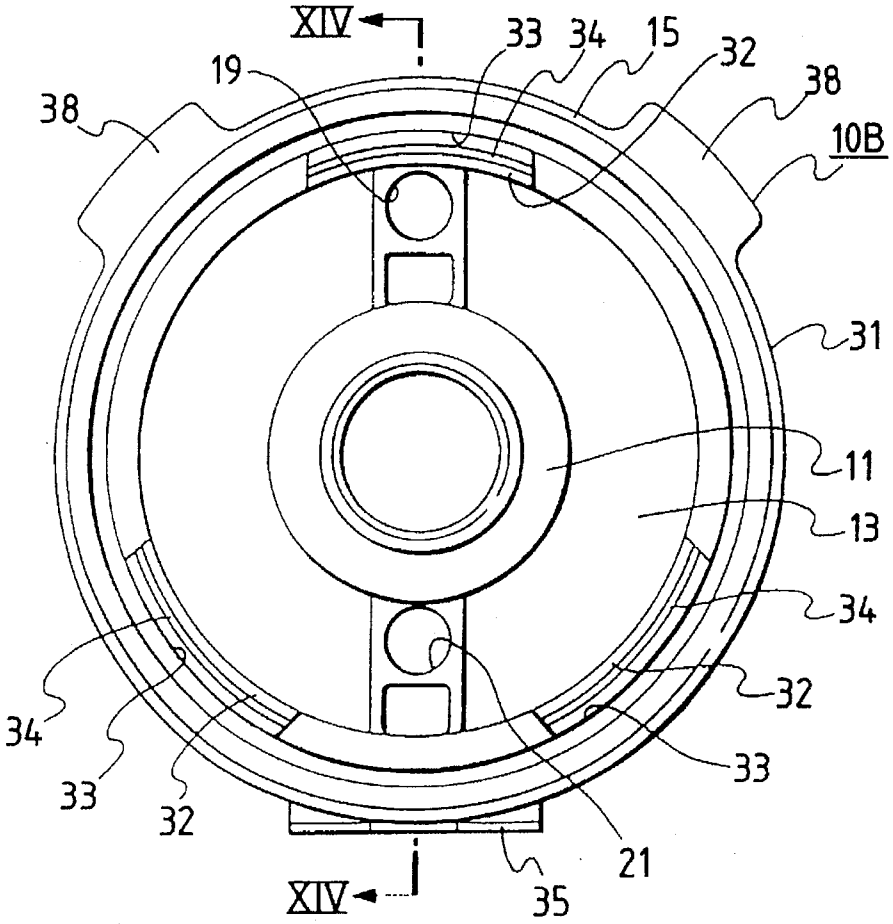
FIG. 13 is a front view of the socket cover according to the second embodiment.
Figure 15:
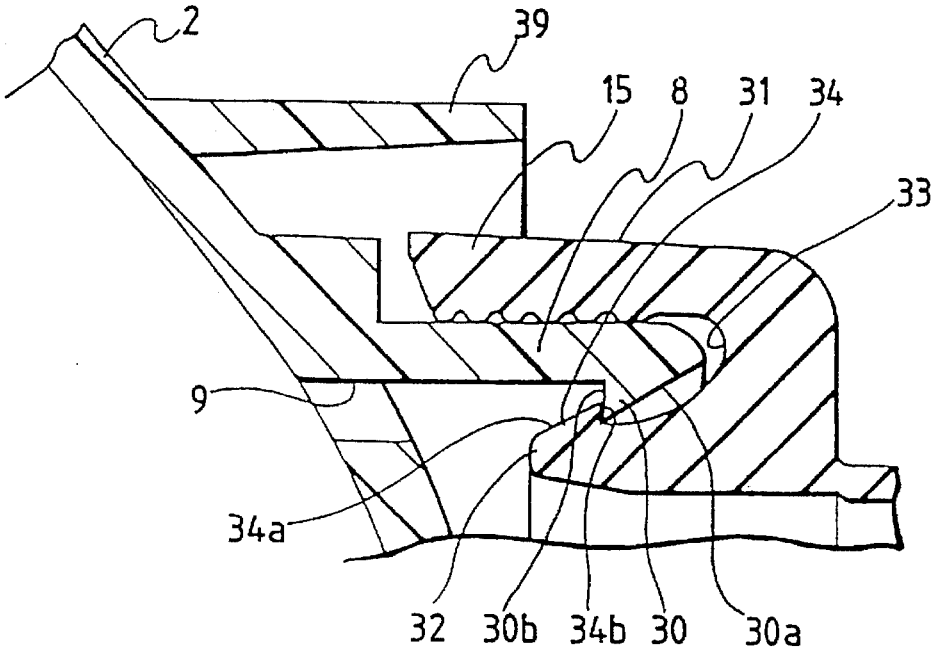
FIG. 15 is an enlarged section view taken along the line XV—XV shown in FIG. 12; and, FIG. 16 is a perspective view of a conventional car lamp.
Figure 16:
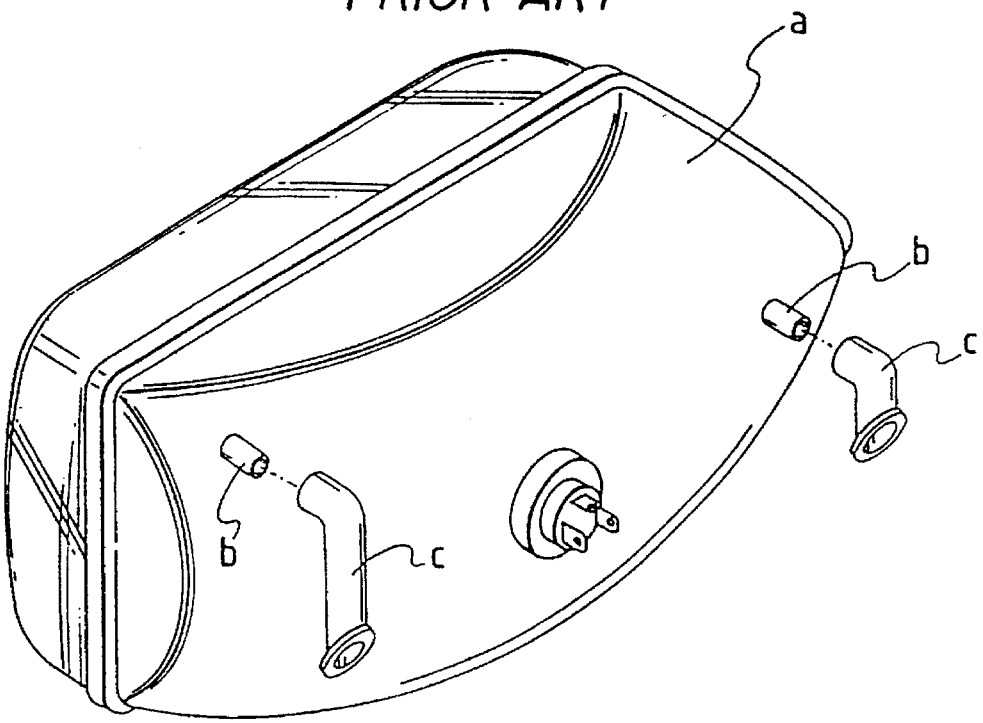
FIG. 16 PRIOR ART

FIGS. 9 to 11 shows a modified version 10A of a socket cover for use with a car lamp according to the invention. The modified socket cover 10A is different from the above socket cover 10 only in the shape of an air introduction member. The remaining portions of the modified socket cover 10A are similar to the socket cover 10. Therefore, description will be given in detail only of an air introduction member 23A employed in the modified socket cover 10A and an air introduction passage 27A which is formed by the air introduction member 23A, whereas the remaining portions of the modified socket cover 10A are given the same designations as those of the socket cover 10 and thus the description thereof is omitted here.

The air introduction member 23A gradually narrows towards the rear end thereof. Due to this, the left and right openings of the air introduction passage 27A formed by the air introduction member 23A approach each other as they go downward.

FIGS. 12 to 15 show a second embodiment of a socket cover for use with a car lamp according to the invention. The second embodiment is different from the first embodiment only in that the inside wall thereof is different in shape and in having a positioning member. However, the remaining portions of the second embodiment are similar to those of the first embodiment. Therefore, only the portions of the second embodiment different from those of the first embodiment will be described below in detail. And, the remaining portions of the second embodiment are given the same reference numerals as the corresponding parts employed in the first embodiment and thus the description thereof is omitted here.

The lamp body 2 includes the enclosing wall 8 on the back surface thereof. At the substantially right upper and diagonally lower positions of the rear end portions of the enclosing wall 8, engaging projections 30 (in FIG. 15, only one of them is shown) project inwardly. Each of the engaging projections 30 includes an inclined surface 30*a* situated on the rear side and displaced toward the central side of the enclosing wall 8 as it goes forward, and a securing surface 30*b* extending to the front end of the inclined surface 30*a* and is substantially perpendicular to the axis of the enclosing wall 8.

A socket cover 10B according to the second embodiment includes a body fitting portion 31. The body fitting portion 31 includes arc-shaped inner walls 32 connected to one another by means of the rear end portions of the enclosing wall 8 and an outer peripheral wall 15 situated outside the inner walls 32. The inner walls 32 are disposed respectively at positions corresponding to the positions of the engaging projections 30. The back and front lengths of each of the inner walls 32 are a little less than those of the outer peripheral wall 15. Between the outer peripheral wall 15 and the inner walls 33, 33, 32 fitting grooves 33, 33, 33 open forward.

In the respective front end portions of the inner walls 32, 34, 34, engaging projections 34, 34, 34 project outwardly. Each of the engaging projections 34, 34, 34 includes an inclined surface 34*a* situated on the front side thereof and displaced toward the outer peripheral wall 15 as it goes backward and a securing surface 34*b* which extends to the rear end of the inclined surface 34*a* and substantially perpendicular to the axis of the socket cover 10B.

An air introduction member 35 is formed in a plate which is long in the back and forth direction. The air introduction member 35 is bent in its thin portions 36, which are respectively formed at a first position in contact with the rear surface of a ventilating pipe 22 and a second position spaced backward away from the first position, into a shape having a U-shaped cross section. The leading end portion of the air introduction member 35 is bonded to the portion of the outer surface of the outer peripheral wall 15 situated immediately under it, thereby forming an air introduction passage 37. Therefore, in the socket cover 10B, there is not provided any securing projection that is provided in both of the above-mentioned socket covers 10 and 10A and is used to fix the air introduction member. Also, the portion of the air introduction member 35 that is situated at the bottom when the air introduction member 35 is fixed to the socket cover 10B is formed narrower toward the leading end thereof.

Positioning projections 38 are respectively provided on and projected from the diagonally upper portions of the outer surface of the outer peripheral wall 15. On the back surface of the lamp body 2, there is provided a substantially arc-shaped protection wall 39. The protection wall 39 projects backwards and encloses the enclosing wall 8 except for the lower portion of the enclosing wall 8. The backward projection of the protection wall 39 is substantially half of that of the enclosing wall 8. The portions 39*a* of the protection wall 39 corresponding to the positioning projections 38 are formed in recessed shapes opened toward the center of the socket cover 10B such that they can correspond to the outer shapes of the positioning projections.

The socket cover 10B can be mounted onto the lamp body 2 in the following manner. The socket cover 10B is pushed into the lamp body 2 from behind in such a manner that the body fitting portion 31 can be fitted with the outside of the enclosing wall 8 and the bulb fitting portion 11 can be fitted with the outside of the base portion 7 of the light source bulb 6. By making the positioning projections 38 correspond to the portions 39*a* of the protection wall 39, the socket cover 10B can be positioned easily.

As a result, at first, the inclined surfaces 34*a* of the engaging projections 34 of the inner walls 32 contact the inclined surfaces 30*a* of the engaging projections 30 of the enclosing wall 8. If the socket cover 10B is pushed further into the lamp body 2, then the engaging projections 34 are flexed inwardly. When the engaging projections 34 go beyond the engaging projections 30, the inwardly flexed engaging portions 34 are returned to their original positions, so that the securing surfaces **34*b* of the engaging projections 34 are engaged with the securing surfaces 30*b* of the engaging projections 30, respectively. The rear end portions of the enclosing wall 8 are fitted into the fitting grooves 33 of the body fitting portion 31. In this manner, the socket cover 10B can be mounted onto the enclosing wall 8 of the lamp body 2**.

As mentioned above, the mounting of the socket cover 10B into the lamp body 2 can be achieved very simply by pushing the socket cover 10B into the lamp body 2 from behind in such a manner that the body fitting portion 31 can be fitted with the outside of the enclosing wall 8 and the bulb fitting portion 11 can be fitted with the outside of the base portion 7 of the light source bulb 6.

In a state in which the socket cover 10E is mounted in the lamp body 2, the enclosing wall 8 is held by and between the outer peripheral wall 15 and inner walls 32. The securing surfaces **34*a* of the engaging projections 34 of the inner walls 32 are engaged with the securing surfaces 30*b* of the engaging projections 30. Therefore, the mounting state of the socket cover 10B is stable and eliminates the danger that the socket cover 10B can slip off the lamp body 2**.

It will be apparent to those skilled in the art what various modifications and variations can be made in the socket cover for use with a car lamp of the present invention without departing from the spirit or scope of the invention. Thus, it is intended that the present invention cover the modification and variations of this invention provided they come within the scope of the appended claims and their equivalents.

What is claimed is:

1. A socket cover integrally formed of an elastic material for covering a bulb mounting hole formed in a lamp body of a car lamp, the car lamp including a lens for covering a front opening of the lamp body and a light source bulb mounted on the lamp body, the socket cover comprising:

a body fitting portion enclosing the bulb mounting hole, the body fitting portion to be fitted to the bulb mounting hole formed in the lamp body, to be connected to a bulb fitting portion of the socket cover, and to receive the light source bulb;

a back surface wall defining ventilating holes disposed in upper and lower portions of the back surface wall;

lower and upper ventilating pipes connected to the respective ventilating holes, the lower and upper ventilating pipes including outward openings facing downward; and an air introduction member connected with the outward opening of the lower ventilating pipe, the air introduction member for introducing air into an interior of the lamp body.

2. The socket cover as claimed in claim 1, wherein the body fitting portion includes an outer peripheral wall and an inside wall connected to each other at rear ends thereof.

3. The socket cover as claimed in claim 1, wherein:

the air introduction member includes a plate-shaped member which projects from the back surface wall where the outward opening of the lower ventilating pipe is formed, the air introduction member is substantially U shaped, and a leading end portion of the air introduction member is connected to the body fitting portion thereby forming an air introduction passage opening left and right.

4. The socket cover as claimed in claim 1, wherein the air introduction member narrows toward a leading end thereof.

5. The socket cover as claimed in claim 1, further comprising a securing projection.

6. The socket cover as claimed in claim 1, wherein the air introduction member is connected to an outer peripheral wall of the body fitting portion.

7. The socket cover as claimed in claim 1, wherein the body fitting portion includes engaging projections for mounting the socket cover to the lamp body.

8. The socket cover as claimed in claim 1, wherein the air introduction member includes:

a first thin portion connected to a ventilating hole of the car lamp;

a second thin portion;

a first plate between the first and the second thin portions; and a second plate extending from the second thin portion, covering a bottom of the ventilating hole, and attached to a wall of the socket cover.

9. The socket cover as claimed in claim 1, wherein the air introduction member receives air from its right and left sides and blocks air from its bottom and the rear.

10. A car lamp comprising:

a lamp body defining a bulb mounting hole;

a light source; and a socket cover integrally formed of an elastic material for covering the bulb mounting hole, the socket cover including:

a body fitting portion for retaining the lamp body, a bulb fitting portion for receiving the light source;

a back surface wall defining ventilating holes disposed in upper and lower portions of the back surface wall, ventilating pipes connected to the ventilating holes and including outward openings facing downward, and an air introduction member connected to the outward opening of a lower ventilating pipe, the air introduction member for introducing air into the lamp body.

11. The car lamp as claimed in claim 10, wherein the body fitting portion includes an outer peripheral wall and an inside wall, the walls being connected to each other at rear ends thereof.

12. The car lamp as claimed in claim 10, wherein the air introduction member includes a plate-shaped member which projects from the back surface wall at the outward opening of a lower ventilating pipe, wherein the air introduction member is substantially U shaped, and wherein a leading end portion of the air introduction member is connected to the body fitting portion thereby forming an air introduction passage opening left and right.

13. The car lamp as claimed in claim 10, wherein the air introduction member narrows toward a leading end thereof.

14. The car lamp as claimed in claim 10, further comprising a securing projection.

15. The car lamp as claimed in claim 10, wherein the air introduction member extends from an outer peripheral wall of the body fitting portion.

16. The car lamp as claimed in claim 10, wherein the body firing portion includes engaging projections for mounting the socket cover to the lamp body.

17. The car lamp as claimed in claim 10, wherein the air introduction member includes:

a first plate extending from the outward opening of a ventilating pipe provided in a lower portion of the back surface wall, the first plate forming a rear wall of the air introduction member; and a second plate extending from the first plate, the second plate disposed beneath the outward opening of the ventilating pipe provided in a lower portion of the back surface wall and forming a lower wall of the air introduction member.

18. The car lamp as claimed in claim 17, wherein the air introduction member further includes:

a first thin portion disposed between the first plate and the outward opening of the lower ventilating pipe, and a second thin portion disposed between the first and the second plates.

19. The car lamp as claimed in claim 10, wherein the air introduction member receives air from its right and left sides and blocks air from its bottom and the rear.

* * * * *